US012343788B2

(12) United States Patent
Sal'nikov et al.

(10) Patent No.: US 12,343,788 B2
(45) Date of Patent: Jul. 1, 2025

(54) CONTINUOUS CASTING MOULD

(71) Applicant: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

(72) Inventors: Aleksandr Vladimirovich Sal'nikov, Krasnoyarsk (RU); Ivan Stanislavovich Victorovskij, Krasnoyarsk (RU); Aleksandr Gennad'evich Pelevin, Krasnoyarsk (RU); Viktor Fedorovich Frolov, Krasnoyarsk (RU); Aleksandr Nikolaevich Alabin, Krasnoyarsk (RU)

(73) Assignee: OBSHCHESTVO S OGRANICHENNOY OTVETSTVENNOST'YU "OBEDINENNAYA KOMPANIYA RUSAL INZHENERNO-TEKHNOLOGICHESKIY TSENTR", Krasnoyarsk (RU)

( * ) Notice: Subject to any disclaimer, the term of this patent is extended or adjusted under 35 U.S.C. 154(b) by 147 days.

(21) Appl. No.: 17/767,885

(22) PCT Filed: Sep. 21, 2020

(86) PCT No.: PCT/RU2020/050235

§ 371 (c)(1),
(2) Date: Apr. 9, 2022

(87) PCT Pub. No.: WO2021/071395

PCT Pub. Date: Apr. 15, 2021

(65) Prior Publication Data

US 2023/0226599 A1 Jul. 20, 2023

(30) Foreign Application Priority Data

Oct. 10, 2019 (RU) ..... RU2019132031

(51) Int. Cl.
*B22D 11/06* (2006.01)
*B22D 11/22* (2006.01)

(52) U.S. Cl.
CPC ..... *B22D 11/0602* (2013.01); *B22D 11/068* (2013.01); *B22D 11/0682* (2013.01); *B22D 11/0685* (2013.01); *B22D 11/22* (2013.01)

(58) Field of Classification Search
CPC ..... B22D 11/0602; B22D 11/068; B22D 11/0682; B22D 11/0685; B22D 11/22
See application file for complete search history.

(56) References Cited

U.S. PATENT DOCUMENTS 3,596,702 A * 8/1971 Ward ..... B22D 11/068 164/126
3,800,852 A 4/1974 Properzl
2015/0068700 A1 3/2015 Dratner et al.

FOREIGN PATENT DOCUMENTS

RU 2623559 C1 6/2017
RU 2628805 C2 8/2017
RU 2643286 C1 1/2018

OTHER PUBLICATIONS

International Search Report and Written Opinion dated Jan. 28, 2021 in connection with International Application No. PCT/RU2020/050235, 8 pages.

(Continued)

*Primary Examiner* — Kevin P Kerns
*Assistant Examiner* — Steven S Ha
(74) *Attorney, Agent, or Firm* — Baker & McKenzie LLP

(57) ABSTRACT

The mould contains a casting wheel, on the outer surface of which an open channel is made, a continuous tape adjacent (Continued)

to the casting wheel from its outer surface in such a way as to close the specified open channel, as well as a cooling system able of adjustable supply of coolant to the casting wheel and the continuous tape at least on the outer surface, on the inner surface and on both side surfaces of the wheel, in which the ratio of the coolant flow on the inner surface of the wheel to the coolant flow on the outer surface of the wheel is 1.9-3.0, and the ratio of the total coolant flow on the side surfaces of the casting wheel to the coolant flow on the inner surface of the casting wheel is 1.3-1.7.

15 Claims, 3 Drawing Sheets

(56) References Cited

OTHER PUBLICATIONS

Search Report dated Dec. 12, 2019 in connection with Russian patent application No. 2019132031, 2 pages.
International Search Report relating to European Patent Document 4 043 121 A1, 2 pages.
Report on the Prosecution, State Intellectual Property Office, relating to Chinese Patent Application No. 2020800675655, dated Feb. 23, 2023, 8 pages.
Office Action, relating to Japanese Patent Application No. 2022-520785, 6 pages.

* cited by examiner

CONTINUOUS CASTING MOULD

CROSS-REFERENCE TO RELATED APPLICATIONS

This application is a U.S. National Stage entry of and claims priority to PCT Application No. PCT/RU2020/050235 filed Sep. 21, 2020, which itself claims priority to Russian Patent Application No. RU2019132031 filed Oct. 10, 2019. The contents from all of the above are hereby incorporated in their entirety by reference.

FIELD OF THE INVENTION

The invention relates to the field of metallurgy, in particular to the continuous casting of metals, and can be used to produce continuous cast ingots of metal, including aluminium and its alloys.

BACKGROUND OF THE INVENTION

A cooling device is known, which is used in a wheel-belt type continuous casting plant (IT1126618, May 21, 1986). The cooling device contains a ring provided with holders of nozzles spraying coolant. The ring is put on the casting wheel to provide cooling of the ingot during casting, and can be removed during maintenance. The disadvantage of this device is the uneven cooling of the ingot, which, during metal solidification, leads to segregation of impurities, cracks, surface roughness and brittleness. In addition, the known device provides insufficient cooling speed, which leads to a decrease in production capacity.

A device for high-speed continuous casting is known (U.S. Pat. No. 3,774,669, Nov. 27, 1973). The known device is a mould containing a nozzle spraying coolant on the outer side of the casting wheel, intensifying the process of secondary cooling of the cast ingot. The disadvantage of this device is the uneven cooling of the ingot, which leads to the formation of defects mainly in the central part of the cast ingot in the form of shrinkage holes.

Another known device meant for the production of aluminium and copper ingots is the mould proposed in RU 2623559, Jun. 27, 2017. The known mould is characterised in that the calibre in the form of a trapezoid in the radial section of the casting wheel of a rotary casting machine contains a hollow made in the form of an isosceles triangle, in which the angle at the apex of the triangle and the angles formed by the sides of the triangle and the sides of the trapezoid are equal to each other and amount to 123° . . . 130°. The advantage of this device is the reduction of the heat affected zone, which reduces the likelihood of cracking and destruction of the surface of the mould, increasing its service life. Among the disadvantages of the proposed mould design, it is necessary to highlight the need to perform an additional operation of adjusting the shape of the cast ingot obtained using the known device.

A cooling system meant for a continuous casting plant is known (U.S. Pat. No. 4,957,155, Sep. 18, 1990). In the known plant, directional solidification is implemented due to the presence of a heat-insulating layer on the casting wheel belt, while some coolant is fed into the groove of the casting wheel through the lower holes to improve cooling. All the external sprinklers in their entirety provide directed and intensive solidification of the ingot from top to bottom, creating a maximum heat transfer difference. As a result of the use of the known cooling system in the plant, the obtained ingot is formed with a minimum number of casting defects. The disadvantage of this technical solution is a difficult for implementation cooling system with a relatively low production capacity due to the longer time required for solidification of the ingot.

The closest analogue of the claimed invention is the cooling device in the continuous casting plant (U.S. Pat. No. 3,800,852, Feb. 4, 1974). The known cooling device contains rows of nozzles of the internal sprinkler cooling the casting wheel, and rows of nozzles of the external sprinkler cooling the belts. At the same time, only the nozzles of the external sprinkler are provided with coolant flow control function. The disadvantage of this device is inefficient control of the coolant flow resulting in the formation of defects in the ingots (cracks, surface roughness), as well as insufficient cooling speed resulting in a decrease in production capacity.

DISCLOSURE OF THE INVENTION

The technical task of the claimed invention is to ensure uniform and controlled cooling of the inner, outer and side surfaces of the casting wheel in order to obtain a continuously cast ingot of high quality.

The technical result of the claimed invention is to increase the manufacturability of continuously cast ingots, to increase the speed of its production and to improve its quality by eliminating the formation of solidification defects, i.e., obtaining continuously cast ingots that essentially do not contain cracks, voids, etc.

The claimed technical results of the invention are achieved by the proposed continuous casting mould.

In accordance with the invention, the continuous casting mould contains a casting wheel, on the outer surface of which an open channel is made with a cross-section in the form of an isosceles trapezoid (i.e., a trapezoidal cross-section), a continuous belt (i.e., an infinite length belt) adjacent to the casting wheel by its outer surface in such a way as to close the specified open channel, and also contains a cooling system.

The ratio of the length of the large base of trapezoidal cross-section of the open channel of the casting wheel to the length of the small base of trapezoidal cross-section is in the range of 1.3-1.6.

The cooling system is made with the possibility of adjustable supply of coolant to the casting wheel and the continuous belt on at least four sides: on the sides of the outer surface, the inner surface and both side surfaces of the wheel, and the ratio of the coolant flow on the side of the inner surface of the wheel to the coolant flow on the side of the outer surface of the wheel is 1.9-3.0, and the ratio of the total coolant flow on the side surfaces of the casting wheel to the coolant flow on the side of the inner surface of the casting wheel is 1.3-1.7.

Such a cooling system is able to provide primary cooling, i.e., cooling of a continuous cast ingot during metal solidification, and secondary cooling of a continuous cast ingot, i.e., cooling of solidified metal, while the peripheral part of the ingot cools faster than its central part. It was experimentally established that the difference in cooling rates between any central part and any peripheral part of an ingot does not exceed 1.5 times.

The cooling system can include at least four arc-shaped tubular sprinklers located along the outer, inner and side surfaces of the casting wheel and made with the possibility of adjustable supply of coolant to the corresponding surfaces of the casting wheel and the belt:

an external sprinkler located on the side of the outer surface of the casting wheel and the continuous belt for supplying coolant to them;

an internal sprinkler located on the side of the inner surface of the casting wheel for supplying coolant to it;

a right-side sprinkler and a left-side sprinkler located on the side of the right-side surface and the left-side surface of the casting wheel, respectively, and used for supplying coolant to them.

The controlled supply of coolant can be carried out through the nozzles distributed along the entire length of each sprinkler.

The control of the coolant flow can be carried out by controlling the shut-off valves and the corresponding flow control nozzles.

Tubular sprinklers can be divided into independent zones with the help of internal transverse partitions to ensure an adjustable supply of coolant independently to each zone.

Each of the above independent zones can be provided with an individual control of coolant supply ensuring regulated coolant supply to this zone. Thus, the cooling control system can be configured individually for each independent zone.

The supply of coolant from the sprinklers to the casting wheel and belt can be carried out through flat-flame nozzles with individual coolant flow control units.

Water is usually used as the coolant, but it is also possible to use other liquids suitable for this purpose, for example, ethylene glycol, which is used for special alloys, such as aluminium-lithium alloys.

In accordance with another aspect, the present invention relates to a method for cooling the continuous cast ingot using the proposed mould, which includes the supply of coolant to the mould casting wheel and the continuous belt on at least four sides: on the outer, inner and both side surfaces of the wheel, while controlling the coolant flow according to the following ratios:

the ratio of the flow rate on the inner surface of the casting wheel to the flow rate on the outer surface of the wheel is in the range of 1.9-3.0;

the ratio of the total coolant flow on the side of the side surfaces of the casting wheel to the coolant flow on the side of the inner surface of the casting wheel is in the range of 1.3-1.7.

The coolant supply can be carried out through at least four arc-shaped tubular sprinklers located along the outer surface, inner surface and side surfaces of the casting wheel and made with the possibility of adjustable coolant supply:

an external sprinkler located on the side of the outer surface of the casting wheel and the continuous belt for supplying coolant to them;

an internal sprinkler located on the side of the inner surface of the casting wheel for supplying coolant to it;

a right-side sprinkler and a left-side sprinkler located on the side of the right-side surface and the left-side surface of the casting wheel, respectively, and used for supplying coolant to them.

The coolant can be supplied through nozzles distributed along the entire length of each sprinkler.

The control of the coolant flow can be carried out by controlling the shut-off valves and the corresponding flow control nozzles.

Tubular sprinklers can be divided into independent zones with the help of internal transverse partitions to ensure an adjustable supply of coolant independently to each zone.

Each of the above independent zones can be provided with an individual control of coolant supply ensuring regulated coolant supply to this zone. Thus, the cooling control system can be configured individually for each independent zone.

The controlled supply of coolant from the sprinklers to the casting wheel and belt can be carried out through flat-flame nozzles with individual coolant flow control units.

According to one of the embodiments of the invention, the device and method are intended for the production of continuous cast ingots from aluminium-based alloys containing at least one alloying element selected from the group: iron, silicon, magnesium, zirconium, scandium, manganese, titanium, copper, nickel and chromium, while the structure of the cast ingot is an aluminium matrix with particles of eutectic origin distributed in it.

The justification of the claimed parameters of the mould, which ensure the achievement of technical results—increasing the manufacturability of continuous cast ingots, improving their quality, as well as increasing the production capacity of the mould (by increasing ingot production rate), is presented below.

The ratio of the length of the large base of trapezoidal cross-section of the open channel of the casting wheel to the length of the small base of trapezoidal cross-section should be in the range of 1.3-1.6.

If the ratio of the specified lengths of the large cross-section base and the small cross-section base is more than 1.6, then the resulting continuous cast ingot will have a shape so different from the square shape, which is preferable from the point of view of further processing the ingot into a product, that additional operations will be required to calibrate it, which will negatively affect the manufacturability of the ingot.

If the ratio of the specified lengths of the large cross-section base and the small cross-section base is less than 1.3, then when casting alloys with low linear shrinkage, cold cracks can form due to the difficulty of extracting the ingot from the open channel of the casting wheel, and, consequently, the quality of the ingot can deteriorate.

The ratio of the coolant flow from the internal sprinkler (i.e., on the side of the small cross-section base of the open channel of the casting wheel) to the coolant flow from the external sprinkler (on the side of the large cross-section base) should be in the range of 1.9-3.0.

If, when regulating the coolant flow of the sprinklers, the specified ratio is less than 1.9 or more than 3.0, then the crystallisation sump will be shifted closer to the large and small base of the trapezoid, respectively, which will lead to uneven cooling and forming of cracks in the ingot, i.e., to a quality degradation of the ingot.

To form a high-quality internal structure of the cast ingot on different parts of the cooled surfaces of the mould casting wheel, different cooling intensity is required, which depends on the alloy and the production capacity of the mould.

To ensure these conditions, coolant can be supplied to the casting wheel and the belt through arc-shaped tubular sprinklers located along the outer, inner and side surfaces of the casting wheel and separated by internal transverse partitions to ensure an adjustable supply of coolant to independent zones.

Each of the above independent zones can be provided with an individual control of coolant supply ensuring regulated coolant supply to this zone. Thus, the cooling control system can be configured individually for each independent zone.

Coolant can be supplied through flat-flame nozzles with individual coolant flow control units.

For more precise individual adjustment of the coolant flow, a control unit with a needle valve can be installed upstream of each nozzle.

BRIEF DESCRIPTION OF DRAWINGS

The essence of the invention is explained by graphic materials.

IMPLEMENTATION OF INVENTION

Figure 1:
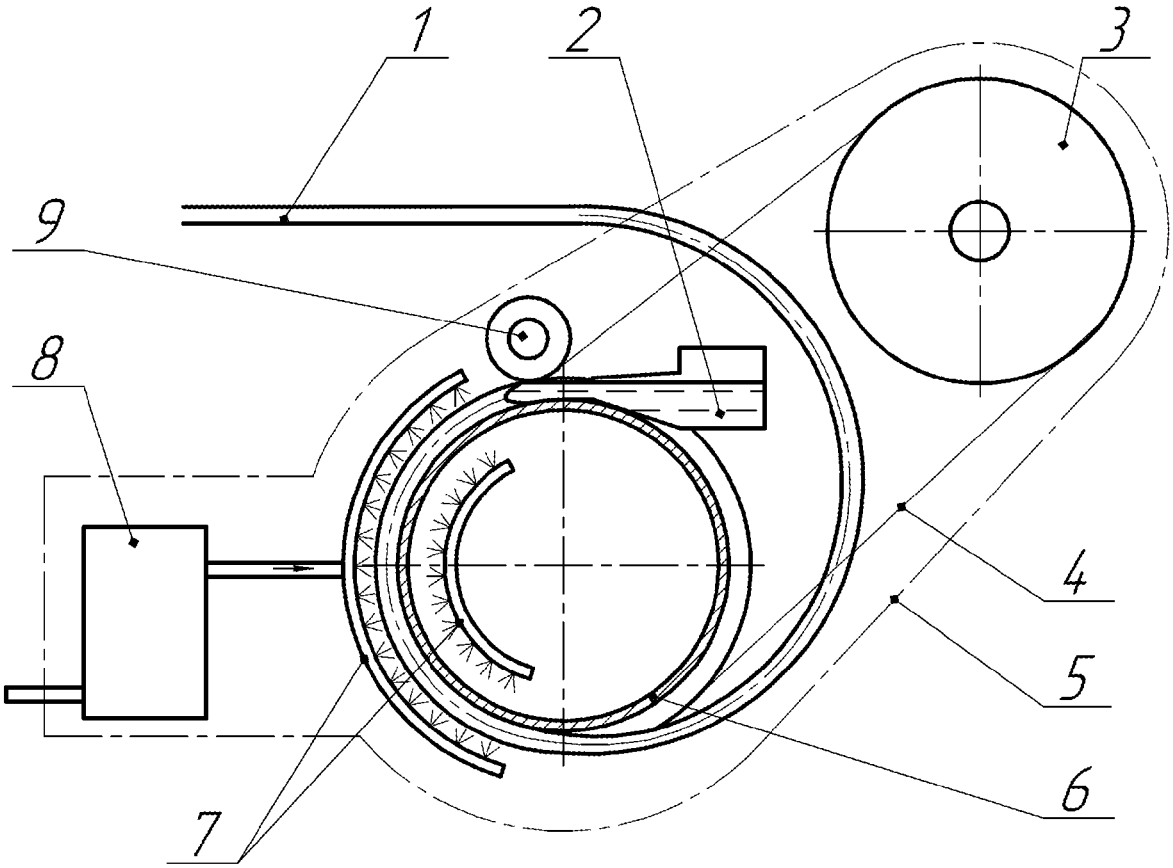
FIG. 1 shows a general view of the mould as part of the casting line, where: 1—continuous cast ingot; 2—metal supply system to the mould wheel; 3—tension wheel of the continuous belt; 4—continuous belt; 5—mould; 6—casting wheel; 7—cooling system nozzles, 8—coolant filter; 9—pressure roller of the continuous belt.

The following are examples of specific embodiments of the invention.

EXAMPLE 1

Justification of the Choice of Geometric Dimensions of the Cross-Section of the Open Channel of the Casting Wheel Forming a Continuous Cast Ingot in the Form of an Isosceles Trapezoid Using the Procast Software Package The purpose of the example is to choose the ratio of the lengths of the bases of the trapezoidal (i.e., in the form of a trapezoid) cross-section of the open channel of the casting wheel ensuring uniform solidification of the metal in a continuous cast ingot.

The following parameters were used as solidification uniformity criteria with a high production capacity of the casting of at least 2 t/hour:

- the presence/absence of vectors of internal tension stresses, primarily in the corners of the large base of the trapezoid;
- the depth of the sump of the solidifying melt, the value of which controls the presence/absence of central shrinkage porosity.
- the absence of significant thermal gradients within the solidification interval.

In the presence of multidirectional vectors of tension stresses, the probability of destruction of the ingot (or of occurrence of cracks) during solidification is high.

In case of a deep sump, the formation of centreline shrinkage porosity is likely due to a change in the thermal gradient during the actual cooling process. The calculations are valid for the cross-section in the range of 1000-3600 $mm^2$.

If there is at least one parameter with the maximum result, there is a high risk of getting an unusable ingot. Qualitative modelling results are shown in Table 1.

TABLE 1

Results of modelling the selection of the trapezoid cross-section

| Item No | The ratio of the length of the large base of trapezoid to the length of the small base of trapezoidal cross-section | Criteria: Sump depth | Criteria: Multidirection of the vector of tension stresses in the corners of the large base of the trapezoid | Criteria: Value of tension stresses in the corners of the large base of the trapezoid |
|---|---|---|---|---|
| 1 | 1.1 | maximum | minimums | maximum |
| 2 | 1.3-1.6 | medium | medium | medium |
| 3 | >2.0 | minimums | maximum | medium |

As can be seen from Table 1, with the ratio of the length of the large base to the length of the small base of the trapezoid equal to 1.1, there is a high probability of formation of a deep central sump during solidification, which can lead to the appearance of maximum shrinkage porosity. When the ratio of the length of the large base of the trapezoid to the length of the small base of the trapezoid is about 1, extraction of the ingot from the mould becomes difficult.

With the ratio of the length of the large base of the trapezoid to the length of the small base of the trapezoid is in the range of 1.3-1.6, the formation of a deep sump is excluded and there are no critical tension stresses.

If the ratio of the length of the large base of the trapezoid to the length of the small base of the trapezoid is higher than 2, the formation of a deep sump is excluded, however, there is a multidirectional vector of tension stresses in the corners of the large base of the trapezoid, which will contribute to the destruction of the ingot during deformation. At the same time, it should be noted that there is a thermal gradient in the corners of the large base of the trapezoid, which will contribute to the formation of segregation zones and, as a result, to the heterogeneity of the chemical composition of the ingot.

Figure 3:
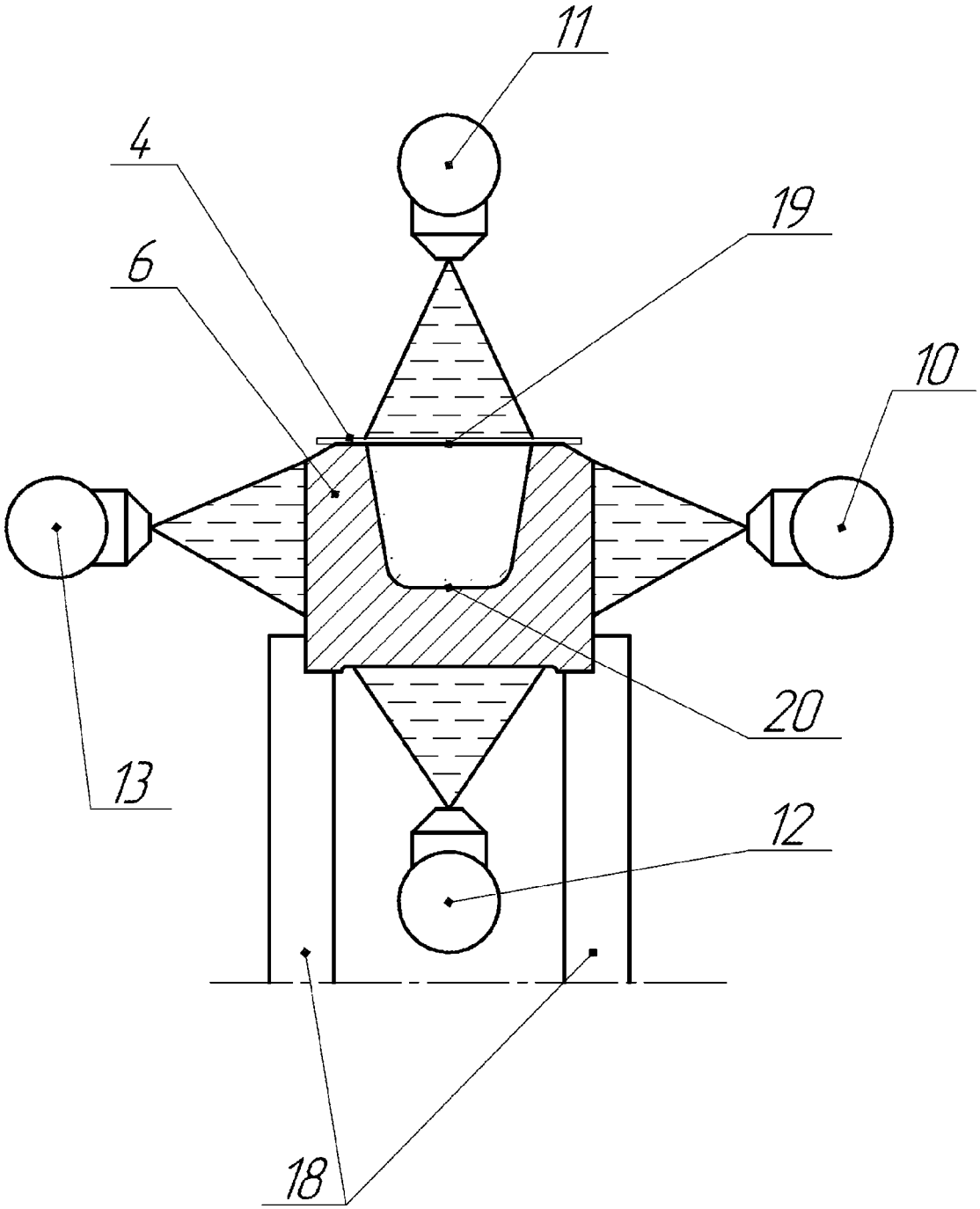
FIG. 3 shows a mould in a cross-section, where: 4—continuous belt, 6—casting wheel, 10—right-side sprinkler; 11—external sprinkler; 12—internal sprinkler; 13—left-side sprinkler; 18—casting wheel attachment rings; 19—large base of trapezoidal cross-section, 20—small base of trapezoidal cross-section.

Based on the results obtained, a mould 5 was made (FIG. 1) with an open channel having a trapezoidal cross-section with a large base 19 and a small base 20, as shown in FIG. 3. The mould 5 contains a casting wheel 6, a continuous belt 4 and a cooling system. The continuous tape 4 is wound through a tightening wheel 3. The belt pressure roller 9 presses the belt 4 to the wheel 6. The casting wheel 6 is installed using attachment rings 18.

The manufactured mould was installed as part of a cast and rolling mill for the production of wire rods made of aluminium and its alloys with a capacity of 2-5 t/hour. The continuous cast ingot was rolled in the stands of a rolling mill to obtain an aluminium wire rod with a diameter of 9.5; 12; 22 mm at the output.

During the operation of the mould 5, liquid metal is fed through the metal supply system 2 into the open channel of the casting wheel 6 of the mould 5, then as a result of metal solidification, a continuous cast ingot 1 is formed between the walls of the channel and the continuous belt 4, which is cooled during the entire solidification process by means of a coolant supplied to the outer surface 15, inner surface 17, side surfaces 16 of the casting wheel 6 and the continuous belt 4 through the nozzles 7 of the cooling system.

Figure 2:
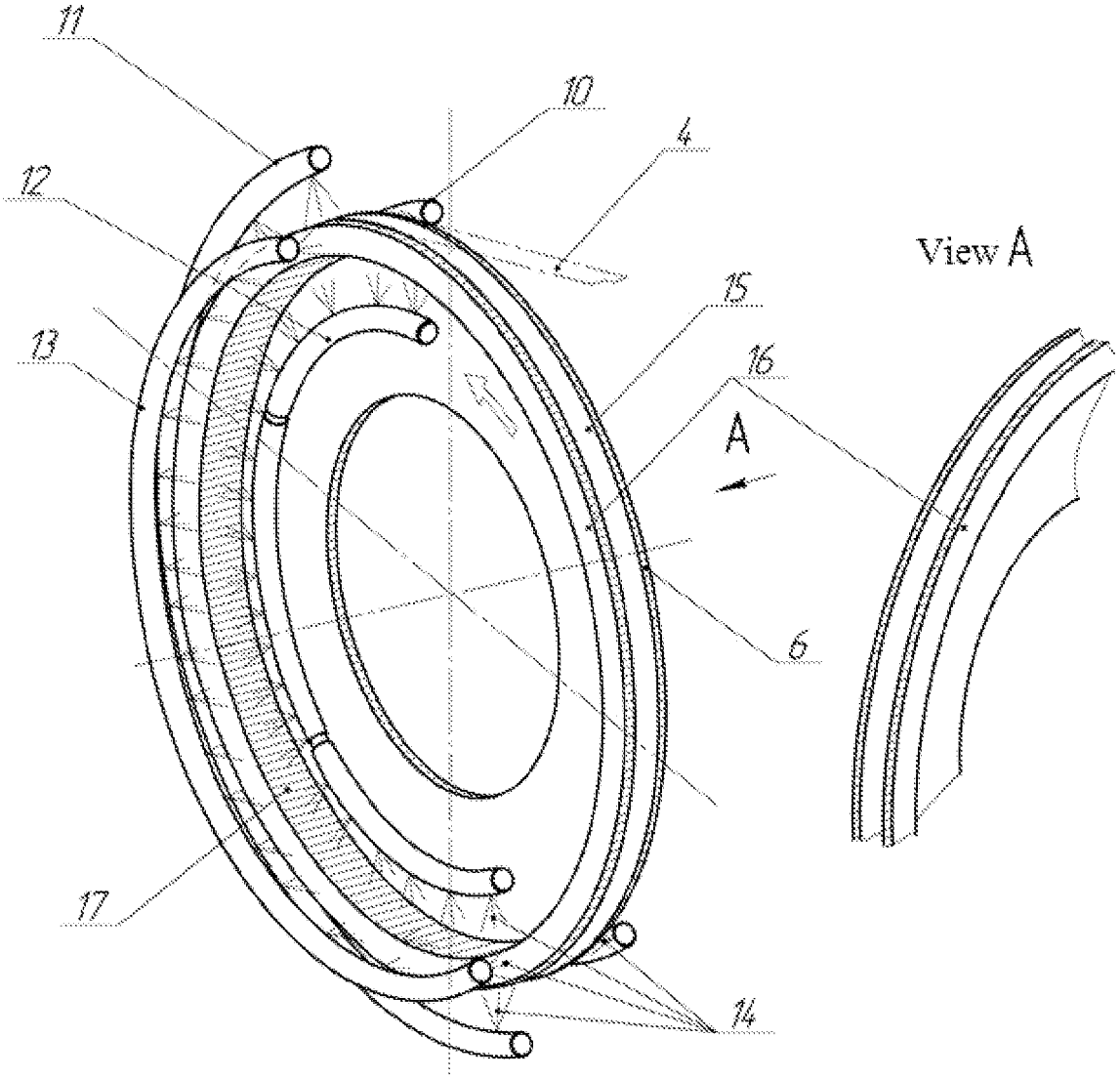
FIG. 2, including view A, shows the coolant distribution pattern (cooling system) of a mould, where: 4—continuous belt; 6—casting wheel; 10—right-side sprinkler; 11—external sprinkler; 12—internal sprinkler; 13—left-side sprinkler; 14—sprinkler nozzles; 15—outer surface of the wheel; 16—side surfaces of the wheel; 17—inner surface of the wheel, view A shows the second side surface 16.

The cooling system of the mould 5 includes four arc-shaped tubular sprinklers located along the outer 5, inner 17 and both side surfaces 16 of the casting wheel 6 and made with the possibility of adjustable coolant supply (FIG. 2 with view A):

an external sprinkler 11 located on the side of the outer surface 15 of the casting wheel 6 and the continuous belt 4 and used for supplying coolant to them;

an internal sprinkler 12 located on the side of the inner surface 17 of the casting wheel 6 and used for supplying coolant to it;

a right-side sprinkler 10 and a left-side sprinkler 13 located on the side of the right-side surface and the left-side surface 16 of the casting wheel 6, respectively, and used for supplying coolant to them.

Nozzles 7 are located: on the internal sprinkler 12 (FIG. 2), divided by internal partitions into three independent zones; on the external sprinkler 11, also consisting of three independent internal zones, as well as on two side sprinklers 10, 13, each of which consists of two independent zones. Each of the above independent zones is provided with an individual water supply control used to control the supply of water to this zone. The cooling control system is configured individually for each independent zone.

The choice of the type of nozzles is determined by the chosen design of the sprinklers and the wheel (wheel size, distance between the sprinklers and the wheel, etc.), since the nozzles form a jet of coolant of a certain shape. In each specific case, the necessary shape of the jet is determined, according to which the type of nozzle is selected. In this case, flat-flame nozzles were installed.

For a more accurate individual adjustment of the water flow, a control unit with a needle valve is installed upstream of each nozzle.

For quick installation/removal of the belt, the right sprinkler and the inner sprinkler can be moved to the side by 20° using a rotary stand (not shown in the drawings).

The parameters of the cooling system of the mould 5 with water used as the coolant are shown in Table 2.

TABLE 2

| Cooling system parameters | | |
|---|---|---|
| 1 | Nr. of nozzles | 158 pcs. |
| 2 | Maximum water flow of the water-cooling system | 9.9 l/min |

A self-cleaning filter 8 (for example, a water filter) can be provided in the coolant (for example, water) supply system (FIG. 1).

Water flow control is carried out in manual and automatic modes. The temperature of the cooling water is controlled before and after the mould 5.

EXAMPLE 2

Determination of the Conditions Ensuring the Obtainment of a Defect-Free Ingot A series of studies was carried out showing the influence of various settings of the cooling system, and those parameters of coolant flow control of the system were found that ensure the production of defect-free continuous cast ingots during solidification.

The melting was performed using an alloy of 6101 type (No 1) and technical aluminium (No 2) as examples, the chemical composition of which is given in Table 3.

TABLE 3

| Chemical composition of alloys, wt. % | | | | | |
|---|---|---|---|---|---|
| Item No | Si | Mg | Fe | Other (each) | Total content of all other impurities |
| 1 | 0.6 | 0.5 | 0.2 | <0.05 | 0.1 |
| 2 | 0.06 | <0.001 | 0.14 | <0.05 | 0.1 |

The following parameters were used as quality evaluation criteria of the ingot:

absence of shrinkage holes with a line production capacity of no less than 2 t/hour.

Coolant (water) control parameters are given in Table 4.

TABLE 4

| Parameters for regulating the ratio of the flow (quantity) of coolant supplied on the sides of the small and large bases of the trapezoid | |
|---|---|
| The ratio of the amount of coolant supplied on the sides of the small and large bases of the trapezoid | Note |
| 1 <1.9 | Production capacity is more than 1.5 t/hour |
| 2 1.9-2.4 | Production capacity is more about 2 t/hour |
| 3 2.4-3.0 | Production capacity is more than 4 t/hour |
| 4 <3.0 | Production capacity is more than 2 t/hour, presence of shrinkage holes in the central part of the ingot |

From the analysis of the results given in Table 4, it follows that when the ratio of the amount of coolant supplied from the small and large base of trapezoidal cross-section of the open channel of the casting wheel is less than 1.9, it is not possible to achieve a production capacity of more than 1.5 t/hour of defect-free cast ingots.

With the ratio of the amount of coolant supplied from the small and large base of trapezoidal cross-section of the open channel of the casting wheel (the coolant flow from the internal sprinkler to the coolant flow from the external sprinkler) in the range of 1.9-3.0, it is possible to completely eliminate the formation of defects in the form of shrinkage holes and to ensure a line production capacity of more than 2 tons/hour of ingots (more than in the prototype), which was confirmed by metallographic studies of the internal structure of the templates of continuous cast ingots.

The most preferable is the ratio of the flow rate (amount) of coolant supplied on the sides of the small and large bases of trapezoidal cross-section of the open channel of the casting wheel (the coolant flow from the internal sprinkler to the coolant flow from the external sprinkler) in the range of 1.9-2.4, which ensures the maximum production capacity of the casting line.

The analysis of the templates showed that when using a mould containing a casting wheel with an open channel of the proposed trapezoidal cross-section, with the specified adjustment settings of the mould cooling system, namely, the ratio of water flow on each sprinkler, it is possible to exclude defects of crystallisation origin in the form of shrinkage holes, cracks of crystallisation origin, while the number of segregates in the corners of large base of the trapezoid (wheel channel cross-section) turned out to be minimal, this was confirmed by the results of a metallographic study of the internal structure of the templates of a continuous cast ingot and is acceptable from the point of view of the ingot quality.

Analysis of the microstructure of a cast ingot made of alloy 6101 (composition No 1 in Table 3) showed that the typical structure of the ingot is represented by an aluminium solution of silicon and magnesium in aluminium and veins of eutectic iron-containing phases. Analysis of the structure of a cast ingot made of technical aluminium (composition No 2 in Table 3) showed that the structure is represented by an aluminium solution with veins of eutectic iron-containing phases. At the same time, the calculated cooling rate within the solidification interval of 6101 alloy and technical aluminium (Table 3) in the entire cross-section was at least 10 K/s. Due to the high cooling rate implemented when using the proposed mould, the structure of the known industrial alloys containing iron, silicon, magnesium, zirconium, scandium, manganese, titanium, copper, nickel and chromium will be represented mainly by an aluminium solution and eutectic phases formed by the corresponding alloying elements.

The use of the claimed mould allows to obtain a continuously cast ingot of high quality (practically without defects), which can be further processed into a product with lower production costs, i.e., the claimed mould allows to increase the manufacturability of the ingot. At the same time, a high production capacity of more than 2 t/hour of the casting line is ensured.

What is claimed is:

1. Continuous casting mould system (1) containing:

a casting wheel (6), on an outer surface (15) of which an open channel is made, having a cross-section in the form of an isosceles trapezoid, and a ratio of a length of a large base (19) of the trapezoid to a length of a small base (20) of the trapezoid is in the range of 1.3-1.6;

a continuous belt (4) adjacent to the casting wheel (6) on a side of its outer surface (15) in such a way as to close the open channel;

a cooling system made with the possibility of an adjustable supply of a coolant to the casting wheel (6) and the continuous belt (4) located at least on a side of the outer surface (15), an inner surface (17) of the casting wheel (6) and both right-side and left-side surfaces (16) of the casting wheel (6), wherein the cooling system is configured to regulate its flow according to the following ratios:

a ratio of coolant flow on a side of the inner surface (17) of the casting wheel (6) to coolant flow on the side of the outer surface (15) of the casting wheel (6) is 1.9-3.0, and a ratio of total coolant flow on a side of the right-side and left-side surfaces (16) of the casting wheel (6) to coolant flow on the side of the inner surface (17) of the casting wheel (6) is 1.3-1.7.

2. The continuous casting mould system according to claim 1, wherein the cooling system includes at least four arc-shaped tubular sprinklers located along the outer surface (15), inner surface (17) and right-side and left-side surfaces (16) of the casting wheel (6) and made with the possibility of adjustable coolant supply, wherein:

an external sprinkler (11) is located on the side of the outer surface (15) of the casting wheel (6) and the continuous belt (4), the external sprinkler (11) being used to supply the coolant to the casting wheel and the continuous belt;

an internal sprinkler (12) is located on the side of the inner surface (17) of the casting wheel (6), the internal sprinkler (12) being used to supply coolant to the inner surface (17) of the casting wheel (6);

a right-side sprinkler (10) and a left-side sprinkler (13) are located on the side of the right-side and left-side surfaces (16) of the casting wheel (6), respectively, the right-side sprinkler (10) and the left-side sprinkler (13) being used to supply coolant to the right-side and left-side surfaces (16) of the casting wheel (6).

3. The continuous casting mould system according to claim 2, wherein the right-side sprinkler (10), the external sprinkler (11), the internal sprinkler (12), and the left-side sprinkler (13) are divided into independent zones by means of internal transverse partitions, in each of which is provided individual control of the coolant flow for a controlled supply of the coolant independently to each zone.

4. The continuous casting mould system according to claim 2, wherein a controlled supply of coolant is carried out through nozzles (7) distributed along an entire length of each of the right-side sprinkler (10), the external sprinkler (11), the internal sprinkler (12), and the left-side sprinkler (13).

5. The continuous casting mould system according to claim 4, wherein the coolant flow is regulated by controlling shut-off valves and corresponding flow control units of the nozzles (7), the nozzle comprising a flat jet nozzle.

6. The continuous casting mould system according to claim 4, wherein the coolant is supplied through flat-flame nozzles with individual coolant flow control units.

7. The continuous casting mould system according to claim 1, wherein water is used as the coolant.

8. The continuous casting mould system according to claim 1, wherein the continuous casting mould is used for solidification of aluminium alloys containing at least one alloying element selected from a group including iron, silicon, magnesium, zirconium, scandium, manganese, titanium, copper, nickel, and chromium.

9. A method for cooling a continuous cast ingot in a continuous casting mould (5), the method including:

adjustably supplying a coolant to a casting wheel (6) of the continuous casting mould (5) and a continuous belt (4) located at least on a side of an outer surface (15), a side of an inner surface (17), and both right-side and left-side-surfaces (16) of the casting wheel (6) when regulating flow of the coolant according to the following ratios:

a ratio of coolant flow on the side of the inner surface (17) of the casting wheel (6) to coolant flow on the side of the outer surface (15) of the casting wheel (6) is in the range of 1.9-3.0;

a ratio of total coolant flow on a side of the right-side and left-side surfaces (16) of the casting wheel (6) to coolant flow on the side of the inner surface (17) of the casting wheel (6) is in the range of 1.3-1.7.

10. The method according to claim 9, wherein the coolant is supplied through at least four arc-shaped tubular sprinklers (10, 11, 12, 13), located along the outer surface (15), the inner surface (17) and the right-side and left-side surfaces (16) of the casting wheel (6) and made with the possibility of adjustable coolant supply, wherein:

an external sprinkler (11) is located on the side of the outer surface (15) of the casting wheel (6) and the continuous belt (4), the external sprinkler (11) being used to supply the coolant to the casting wheel and the continuous belt;

an internal sprinkler (12) located on the side of the inner surface (17) of the casting wheel (6), the internal sprinkler (12) being used to supply coolant to the inner surface (17) of the casting wheel (6); and a right-side sprinkler (10) and a left-side sprinkler (13) are located on the side of the right-side and left-side surfaces (16) of the casting wheel (6), respectively, the right-side sprinkler (10) and the left-side sprinkler (13) being used and used to supply coolant to the right-side and left-side surfaces (16) of the casting wheel (6).

11. The method according to claim 10, wherein tubular sprinklers (10, 11, 12, 13) are divided into independent zones by means of internal transverse partitions, in each of which is provided individual control of the coolant flow for an unregulated supply of the coolant independently to each zone.

12. The method according to claim 10, wherein the coolant is supplied through nozzles (7) distributed along an entire length of each of the tubular sprinklers (10, 11, 12, 13).

13. The method according to claim 12, wherein the control of the coolant flow is carried out by controlling shut-off valves and corresponding flow control units of the nozzles (7).

14. The method according to claim 12, wherein the coolant is supplied through flat-flame nozzles with individual coolant flow control units.

15. The method according to claim 9, wherein water is used as the coolant.

* * * * *